US007066052B2

(12) United States Patent
Chen

(10) Patent No.: US 7,066,052 B2
(45) Date of Patent: Jun. 27, 2006

(54) HAMMER HAVING ENHANCED STRENGTH

(76) Inventor: John Chen, No. 1, Alley 66, Lane 216, Gongye Rd., Longjing Township, Taichung County (TW) 434

( * ) Notice: Subject to any disclaimer, the term of this patent is extended or adjusted under 35 U.S.C. 154(b) by 0 days.

(21) Appl. No.: 10/956,655

(22) Filed: Oct. 1, 2004

(65) Prior Publication Data

US 2006/0070496 A1 Apr. 6, 2006

(51) Int. Cl.
*B25D 11/02* (2006.01)

(52) U.S. Cl. ..... 81/22; 81/20

(58) Field of Classification Search ..... 81/2, 81/20, 22, 25, 489
See application file for complete search history.

(56) References Cited

U.S. PATENT DOCUMENTS

| | | | | |
|---|---|---|---|---|
| 2,983,297 | A * | 5/1961 | Wilson | 81/21 |
| 4,039,012 | A * | 8/1977 | Cook | 81/22 |
| 5,211,085 | A * | 5/1993 | Liou | 81/20 |
| 5,280,738 | A * | 1/1994 | Liou | 81/20 |
| 5,657,674 | A * | 8/1997 | Burnett | 81/20 |
| 6,131,488 | A * | 10/2000 | Coonrad | 81/20 |
| 6,386,070 | B1 * | 5/2002 | Hong | 81/20 |
| 6,647,829 | B1 * | 11/2003 | Youngren et al. | 81/20 |
| 6,763,747 | B1 * | 7/2004 | Gierer et al. | 81/489 |
| 6,874,186 | B1 * | 4/2005 | Lin | 7/144 |
| 6,923,432 | B1 * | 8/2005 | Martinez | 254/26 R |
| 2003/0037641 | A1 * | 2/2003 | Coonrad | 81/20 |
| 2004/0045411 | A1 * | 3/2004 | Youngren et al. | 81/20 |
| 2005/0120830 | A1 * | 6/2005 | Boys | 81/20 |
| 2005/0178243 | A1 * | 8/2005 | Schoor | 81/20 |

* cited by examiner

*Primary Examiner*—David B. Thomas
*Assistant Examiner*—Robert Scruggs
(74) *Attorney, Agent, or Firm*—Charles E. Baxley

(57) ABSTRACT

A hammer includes a handle, a hammer body mounted on an end of the handle and having a side formed with a combination bar inserted into the handle, and a protective jacket integrally formed on the handle to encompass a periphery of the combination bar and a mediate portion of the hammer body entirely. Thus, the protective jacket of the handle encompasses the periphery of the combination bar and the mediate portion of the hammer body entirely, so that the handle and the hammer body are combined with each other rigidly and stably, thereby enhancing the combination strength of the hammer.

8 Claims, 5 Drawing Sheets

HAMMER HAVING ENHANCED STRENGTH

BACKGROUND OF THE INVENTION

1. Field of the Invention

The present invention relates to a hammer, and more particularly to a hammer having an enhanced strength.

2. Description of the Related Art

A conventional hammer comprises a handle, a head mounted on a first end of the handle, a striking portion integrally formed on a distal end of the head, and a grip mounted on a second end of the handle. However, when the striking portion of the hammer hits a workpiece, such as a nail or the like, the vibration applied by the workpiece on the striking portion is directly transmitted through the head and the handle to a user's one hand, so that the user easily feels uncomfortable, thereby causing inconvenience to the user during operation of the conventional hammer. In addition, the head and the handle are not combined with each other rigidly and stably, thereby greatly decreasing the combination strength of the conventional hammer.

SUMMARY OF THE INVENTION

The present invention is to mitigate and/or obviate the disadvantage of the conventional hammer.

The primary objective of the present invention is to provide a hammer having an enhanced strength.

Another objective of the present invention is to provide a hammer having a shock-absorbing effect.

A further objective of the present invention is to provide a hammer, wherein the protective jacket of the handle encompasses a periphery of the combination bar and the mediate portion of the hammer body entirely, so that the handle and the hammer body are combined with each other rigidly and stably, thereby enhancing the combination strength of the hammer.

A further objective of the present invention is to provide a hammer, wherein the shock-absorbing hole of the hammer body provides a shock-absorbing effect so that the reaction from the striking portion of the hammer body is reduced largely to reduce the impact transmitted from the striking portion of the hammer body to the handle, thereby preventing the reaction from vibrating or injuring a user's wrist.

A further objective of the present invention is to provide a hammer, wherein the shock-absorbing hole of the hammer body provides a shock-absorbing effect to suppress the vibration during the striking process of the hammer, so that the user can operate the hammer in a comfortable manner, thereby enhancing the striking efficiency of the hammer.

A further objective of the present invention is to provide a hammer, wherein the shock-absorbing hole of the hammer body reduces the required material of the hammer, thereby decreasing costs of fabrication of the hammer.

A further objective of the present invention is to provide a hammer, wherein the shock-absorbing hole enhances space of deformation of the hammer body during the hardening treatment, thereby enhancing the working efficiency of the hammer.

In accordance with the present invention, there is provided a hammer, comprising:

a handle;

a hammer body mounted on an end of the handle and having a side formed with a combination bar extended downward and inserted into a hollow inside of the handle; and a protective jacket integrally formed on the handle to encompass a periphery of the combination bar and a mediate portion of the hammer body entirely, so that the handle and the hammer body are combined with each other.

Further benefits and advantages of the present invention will become apparent after a careful reading of the detailed description with appropriate reference to the accompanying drawings.

DETAILED DESCRIPTION OF THE INVENTION

Figure 1:
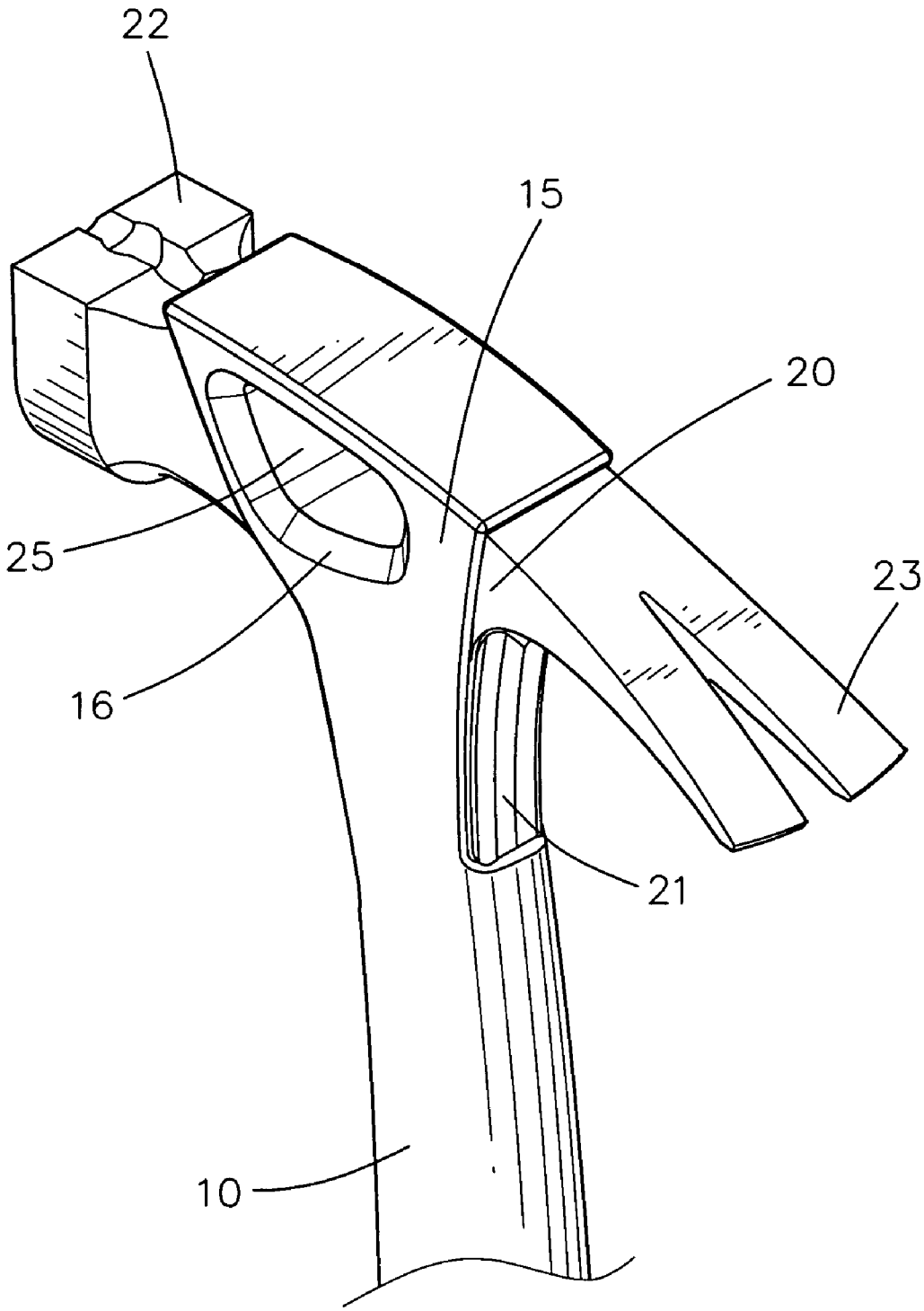
FIG. 1 is a perspective view of a hammer in accordance with the preferred embodiment of the present invention.
Figure 2:
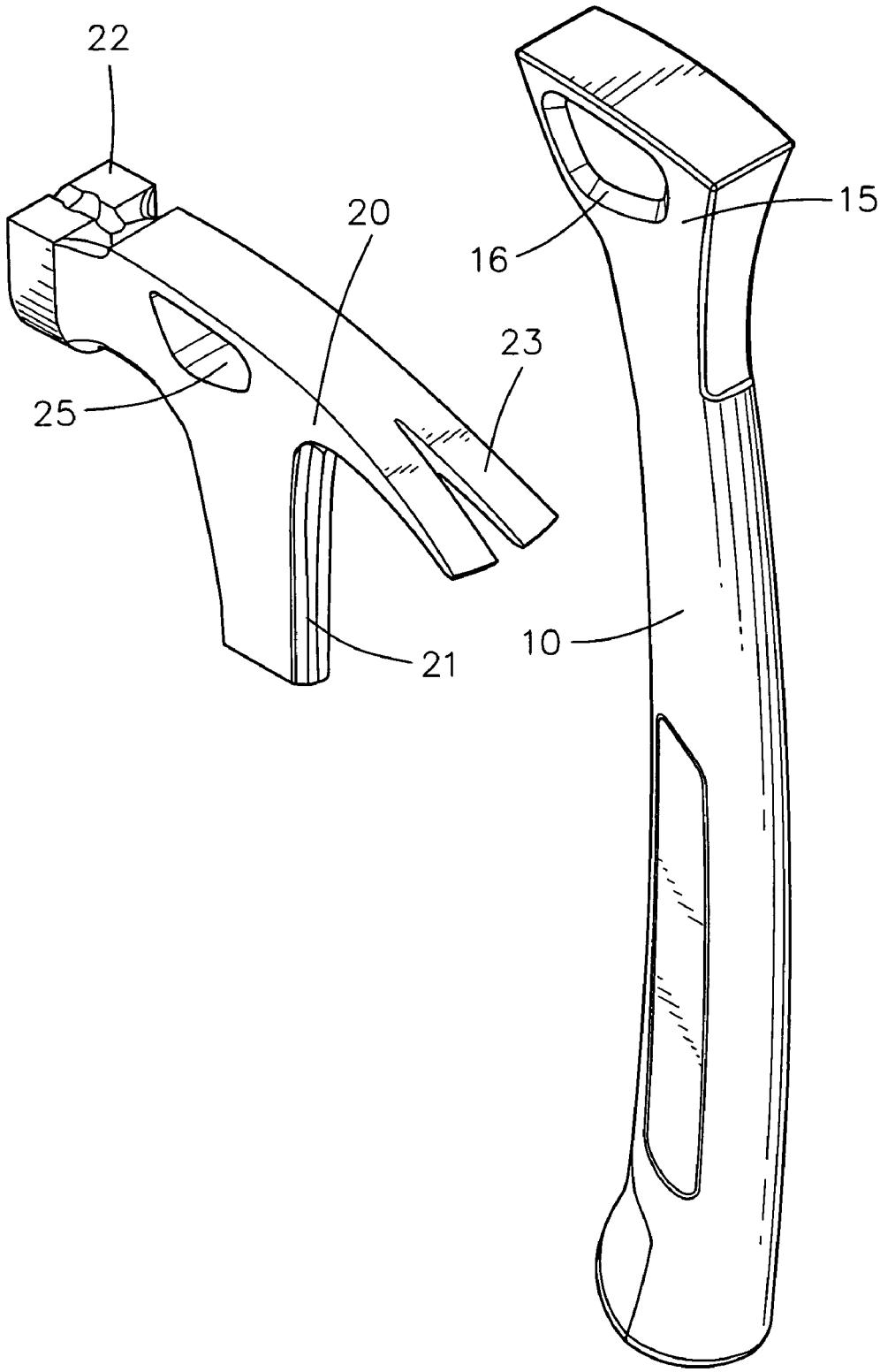
FIG. 2 is an exploded perspective view of the hammer as shown in FIG. 1.

Referring to the drawings and initially to FIGS. 1–4, a hammer in accordance with the preferred embodiment of the present invention comprises a handle 10, and a hammer body 20 mounted on an end of the handle 10.

The hammer body 20 is perpendicular to the handle 10 and has a first end formed with a striking portion 22, a mediate portion formed with a shock-absorbing hole 25 and a second end formed with a nail pull portion 23. The hammer body 20 has a side formed with a combination bar 21 extended downward and inserted into a hollow inside of the handle 10. The combination bar 21 of the hammer body 20 is located at the mediate portion of the hammer body 20.

Figure 3:
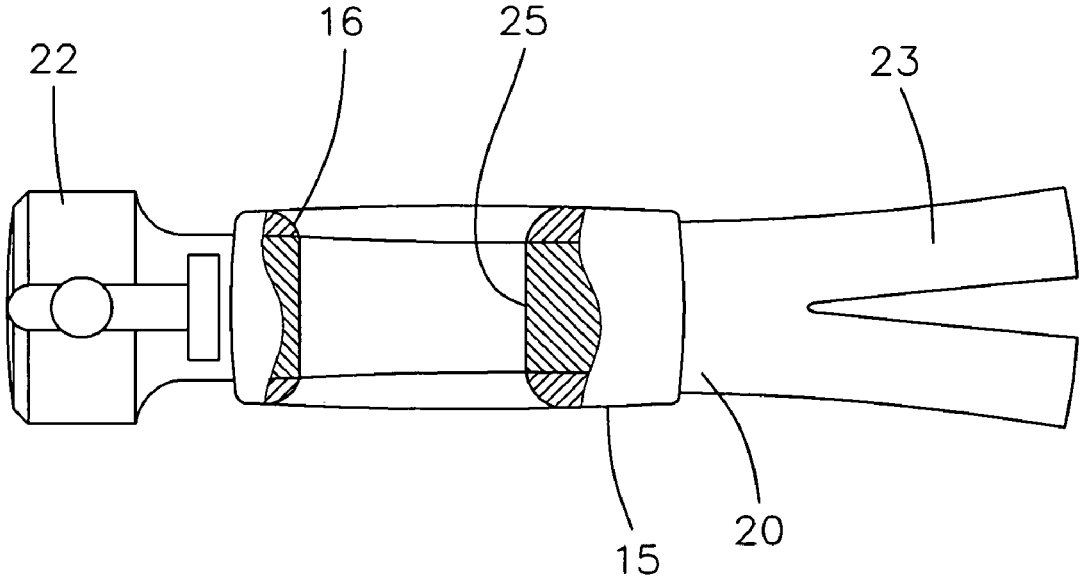
FIG. 3 is a partially top plan cross-sectional view of the hammer as shown in FIG. 1.
Figure 4:
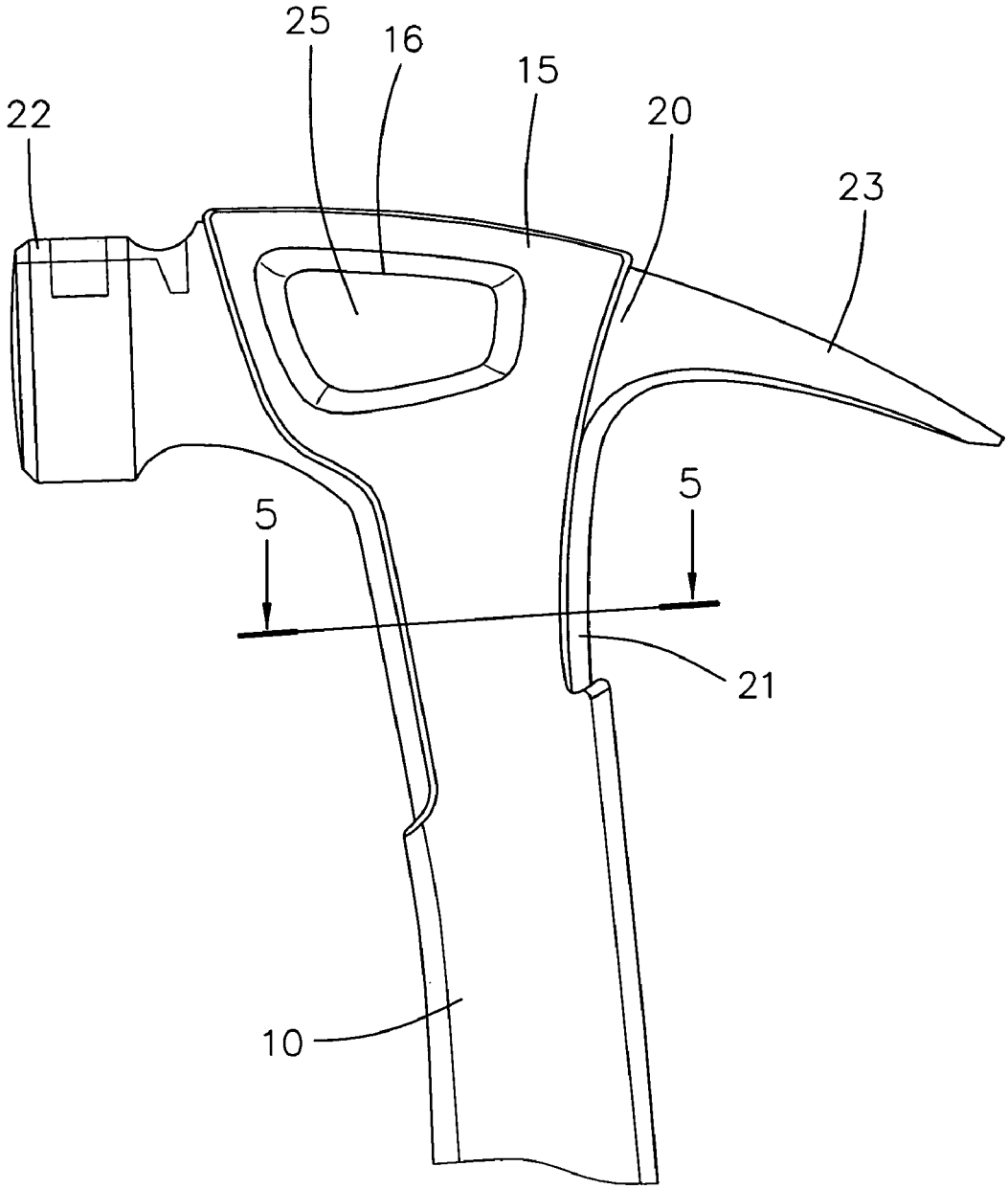
FIG. 4 is a front plan view of the hammer as shown in FIG. 1.

The shock-absorbing hole 25 of the hammer body 20 has an axis perpendicular to a force line of the hammer body 20 as shown in FIG. 3. The shock-absorbing hole 25 of the hammer body 20 is extended through two opposite sides of the hammer body 20. The shock-absorbing hole 25 of the hammer body 20 is located at a side of a longitudinal axis of the handle 10 and adjacent to the striking portion 22 of the hammer body 20, thereby preventing the shock-absorbing hole 25 of the hammer body 20 from decreasing the combination strength of the handle 10 and the hammer body 20.

Preferably, the handle 10 is integrally combined with the hammer body 20 by an injection molding process. A protective jacket 15 is integrally formed on the handle 10 to encompass a periphery of the combination bar 21 and the mediate portion of the hammer body 20 entirely, so that the handle 10 and the hammer body 20 are combined with each other rigidly and stably.

Figure 5:
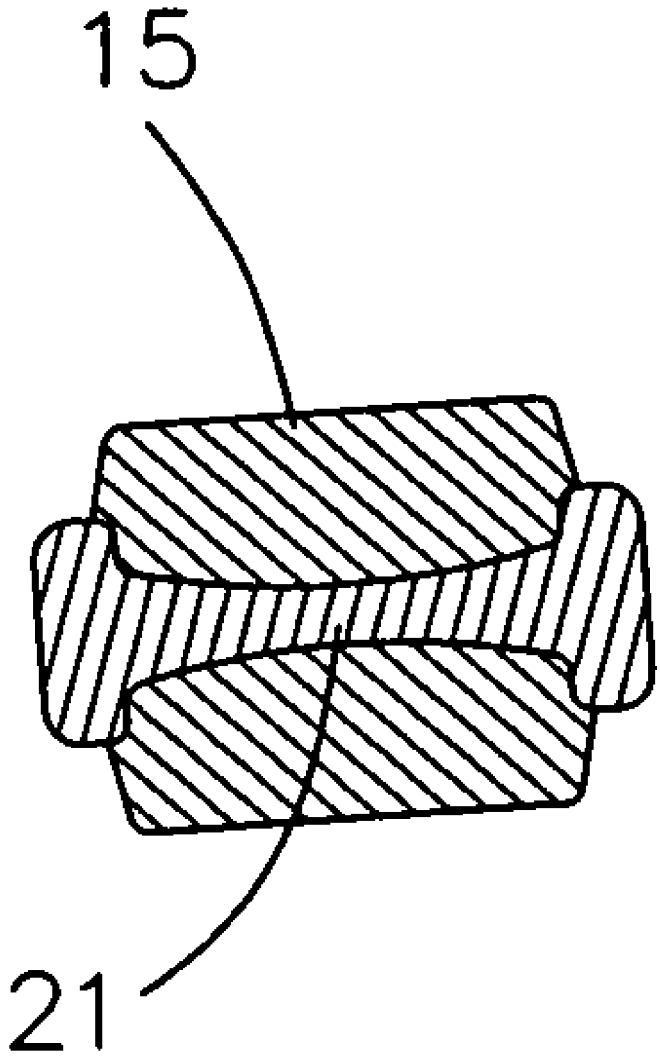
FIG. 5 is a cross-sectional view of the hammer taken along line 5—5 as shown in FIG. 4.

As shown in FIG. 5, the protective jacket 15 encompasses a periphery of the combination bar 21 of the hammer body 20 completely.

As shown in FIG. 3, the protective jacket 15 has two opposite side walls each formed with a through hole 16 aligning with the shock-absorbing hole 25 of the hammer body 20 to enhance the shock-absorbing effect of the shock-absorbing hole 25 of the hammer body 20. Preferably, the through hole 16 of the protective jacket 15 is substantially arc-shaped and is located at a side of the longitudinal axis of the handle 10 adjacent to the striking portion 22 of the hammer body 20.

In operation, when the striking portion 22 of the hammer body 20 hits a workpiece, such as a nail, the reaction applied by the workpiece on the striking portion 22 of the hammer body 20 is suppressed and absorbed by the shock-absorbing hole 25 of the hammer body 20, so that the reaction from the striking portion 22 of the hammer body 20 is reduced largely so as to reduce the impact transmitted from the striking portion 22 of the hammer body 20 to the handle 10, thereby preventing the reaction from vibrating or injuring a user's wrist.

Accordingly, the protective jacket 15 of the handle 10 encompasses a periphery of the combination bar 21 and the mediate portion of the hammer body 20 entirely, so that the handle 10 and the hammer body 20 are combined with each other rigidly and stably, thereby enhancing the combination strength of the hammer. In addition, the shock-absorbing hole 25 of the hammer body 20 provides a shock-absorbing effect so that the reaction from the striking portion 22 of the hammer body 20 is reduced largely to reduce the impact transmitted from the striking portion 22 of the hammer body 20 to the handle 10, thereby preventing the reaction from vibrating or injuring a user's wrist. Further, the shock-absorbing hole 25 of the hammer body 20 provides a shock-absorbing effect to suppress the vibration during the striking process of the hammer, so that the user can operate the hammer in a comfortable manner, thereby enhancing the striking efficiency of the hammer. Further, the shock-absorbing hole 25 of the hammer body 20 reduces the required material of the hammer, thereby decreasing costs of fabrication of the hammer. Further, the shock-absorbing hole 25 enhances space of deformation of the hammer body 20 during the hardening treatment, thereby enhancing the working efficiency of the hammer.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A hammer, comprising:

a handle;

a hammer body mounted on an end of the handle and having a side formed with a combination bar extended downward from the hammer body and inserted into the end of the handle to attach the hammer body to the end of the handle; and a protective jacket integrally formed on the end of the handle to encompass a periphery of the combination bar and a mediate portion of the hammer body entirely, so that the combination bar and the mediate portion of the hammer body are located between the protective jacket and the end of the handle, and the handle and the hammer body are combined with each other; wherein the mediate portion of the hammer body is formed with a shock-absorbing hole;

the shock-absorbing hole of the hammer body is extended through two opposite sides of the hammer body.

2. The hammer in accordance with claim 1, wherein the combination bar of the hammer body is located at the mediate portion of the hammer body.

3. The hammer in accordance with claim 1, wherein the shock-absorbing hole of the hammer body has an axis perpendicular to a force line of the hammer body.

4. A hammer, comprising:

a handle;

a hammer body mounted on an end of the handle and having a side formed with a combination bar extended downward from the hammer body and inserted into the end of the handle to attach the hammer body to the end of the handle; and a protective jacket integrally formed on the end of the handle to encompass a periphery of the combination bar and a mediate portion of the hammer body entirely, so that the combination bar and the mediate portion of the hammer body are located between the protective jacket and the end of the handle, and the handle and the hammer body are combined with each other; wherein the mediate portion of the hammer body is formed with a shock-absorbing hole;

the absorbing-hole of the hammer body is extended through two opposite sides of the hammer body and is located at a side of a longitudinal axis of the handle and adjacent to a striking portion of the hammer body.

5. A hammer, comprising:

a handle;

a hammer body mounted on an end of the handle and having a side formed with a combination bar extended downward from the hammer body and inserted into the end of the handle to attach the hammer body to the end of the handle; and a protective jacket integrally formed on the end of the handle to encompass a periphery of the combination bar and a mediate portion of the hammer body entirely, so that the combination bar and the mediate portion of the hammer body are located between the protective jacket and the end of the handle, and the handle and the hammer body are combined with each other; wherein the mediate portion of the hammer body is formed with a shock-absorbing hole;

the protective jacket has two opposite side walls each formed with a through hole aligning with the shock-absorbing hole of the hammer body.

6. The hammer in accordance with claim 5, wherein the through hole of the protective jacket is substantially arc-shaped.

7. The hammer in accordance with claim 5, wherein the through hole of the protective jacket is located at a side of the longitudinal axis of the handle adjacent to a striking portion of the hammer body.

8. The hammer in accordance with claim 1, wherein the hammer body has a first end formed with a striking portion and a second end formed with a nail pull portion.

* * * * *